US005956856A

United States Patent [19]

Chen et al.

[11] Patent Number: 5,956,856

[45] Date of Patent: Sep. 28, 1999

[54] DRAWING BOARD ASSEMBLY

[76] Inventors: Chiang-Wen Chen; Chiang-Ming Chen, both of No. 42, Kuangteh Rd., Taiping City, Taichung Hsien, Taiwan

[21] Appl. No.: 08/990,223

[22] Filed: Dec. 15, 1997

[51] Int. Cl.[6] ..... A47B 27/00

[52] U.S. Cl. ..... 33/445

[58] Field of Search ..... 33/430, 443, 445, 33/485, 448, 449, 450, 464, 473

[56] References Cited

U.S. PATENT DOCUMENTS

| | | | |
|---|---|---|---|
| 382,234 | 5/1888 | Huges | 33/445 |
| 1,140,143 | 5/1915 | Falvey | 33/445 |
| 3,293,756 | 12/1966 | Picken | 33/445 |
| 3,346,960 | 10/1967 | Miles | 33/445 |
| 4,090,301 | 5/1978 | Della Monica | 33/430 |
| 4,972,590 | 11/1990 | Dentith | 33/430 |
| 5,386,640 | 2/1995 | Chen et al. | 33/430 |
| 5,845,409 | 12/1998 | Kimoto | 33/430 |

*Primary Examiner*—Randy W. Gibson
*Attorney, Agent, or Firm*—Patterson & Keough, P.A.

[57] ABSTRACT

A drawing board assembly includes a rectangular board including two opposite end portions each having a side wall transversely defining an elongate guiding track therein and a top wall. Two inverted L-shaped sliding bases are each slidably supported on a corresponding one of the two end portions of the board and each include a first plate abutting on the top wall and a second plate abutting on the side wall. Two slides are each fixedly mounted on the second plate of a corresponding one of the two sliding bases and are each slidably received in the guiding track A ruler is slidably mounted on the board, and an elongate frame is fixedly mounted on the ruler and includes two end portions each connected with the first plate of a corresponding one of the two sliding bases.

6 Claims, 7 Drawing Sheets

DRAWING BOARD ASSEMBLY

FIELD OF THE INVENTION

The present invention relates to a drawing board assembly.

BACKGROUND OF THE INVENTION

A conventional drawing board assembly is shown in FIG. 7, and a complete illustration will follow in the detailed description of the preferred embodiments.

The present invention has arisen to mitigate and/or obviate the disadvantage of the conventional drawing board assembly.

SUMMARY OF THE INVENTION

In accordance with one aspect of the present invention, there is provided a drawing board assembly comprising a rectangular board including two opposite end portions each having a side wall transversely defining an elongate guiding track therein and a top wall.

Two inverted L-shaped sliding bases are each slidably supported on a corresponding one of the two end portions of the board and each include a first plate abutting on the top wall and a second plate abutting on the side wall. Two slides are each fixedly mounted on the second plate of a corresponding one of the two sliding bases and are each slidably received in the guiding track.

A ruler is slidably mounted on the board, and an elongate frame is fixedly mounted on the ruler and includes two end portions each fixedly connected with the first plate of a corresponding one of the two sliding bases.

Further features of the present invention will become apparent from a careful reading of the detailed description with appropriate reference to the accompanying drawings.

DETAILED DESCRIPTION OF THE PREFERRED EMBODIMENTS

Figure 7:
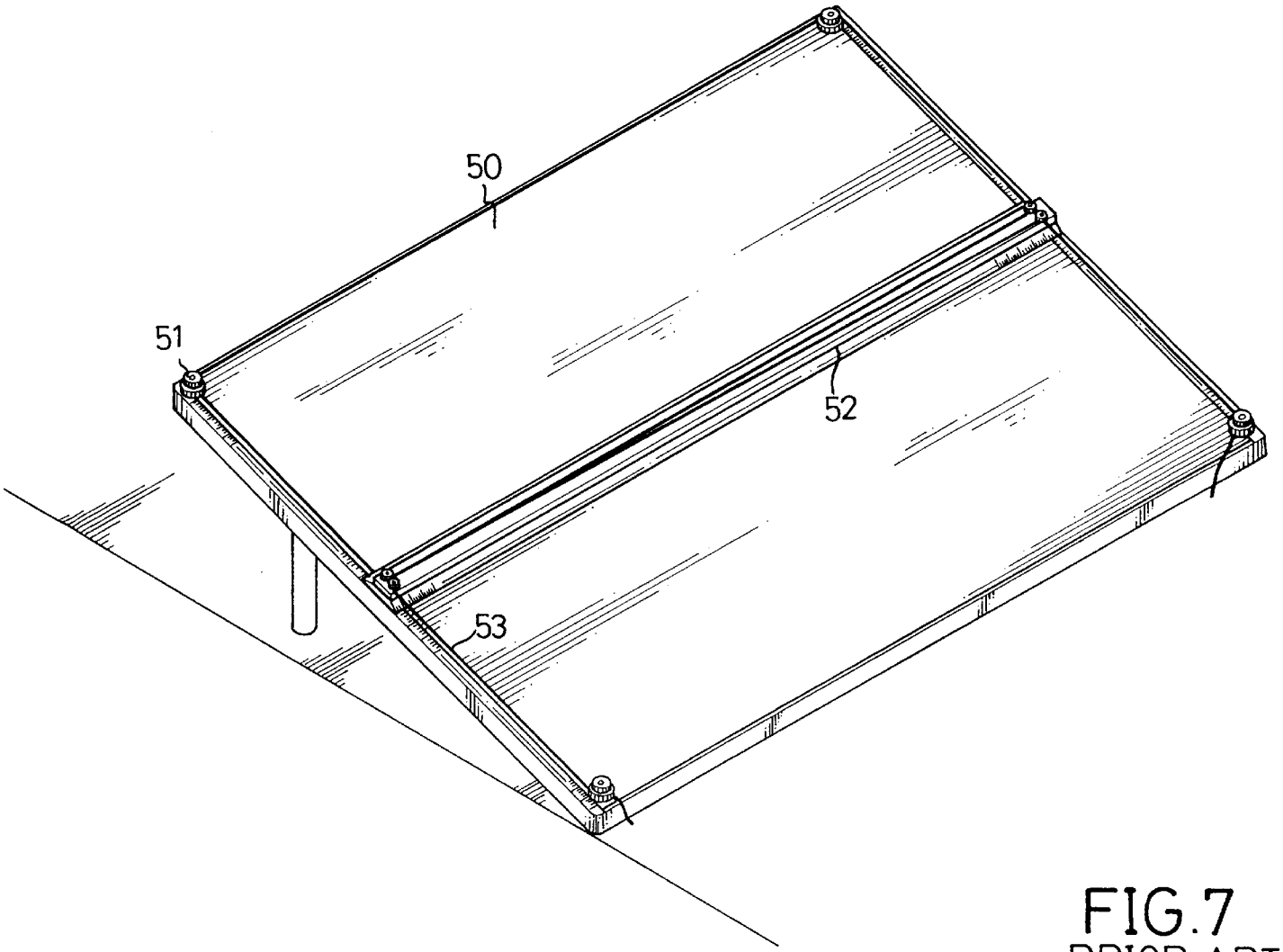
FIG. 7 PRIOR ART
FIG. 7 is a perspective view of a conventional drawing board assembly in accordance with the prior art.

For a better understanding of features and benefits of the present invention, reference is now made to FIG. 7, illustrating a conventional drawing board assembly according to the prior art.

The conventional drawing board assembly comprises a rectangular board 50 including four corners each having a fixed member 51 mounted thereon, a ruler 52 slidably mounted on the board 50, and a guiding line 53 enclosed around each of the four fixed members 51 and around the ruler 52 for guiding the ruler 52 to move upward and downward.

By such an arrangement, however, the ruler 52 tends to swing sidewards because the guiding line 53 cannot provide an efficient effect for positioning the ruler 52 during movement of the ruler 52 on the board 50, thereby easily reducing the accuracy of the drawing board assembly.

Figure 1:
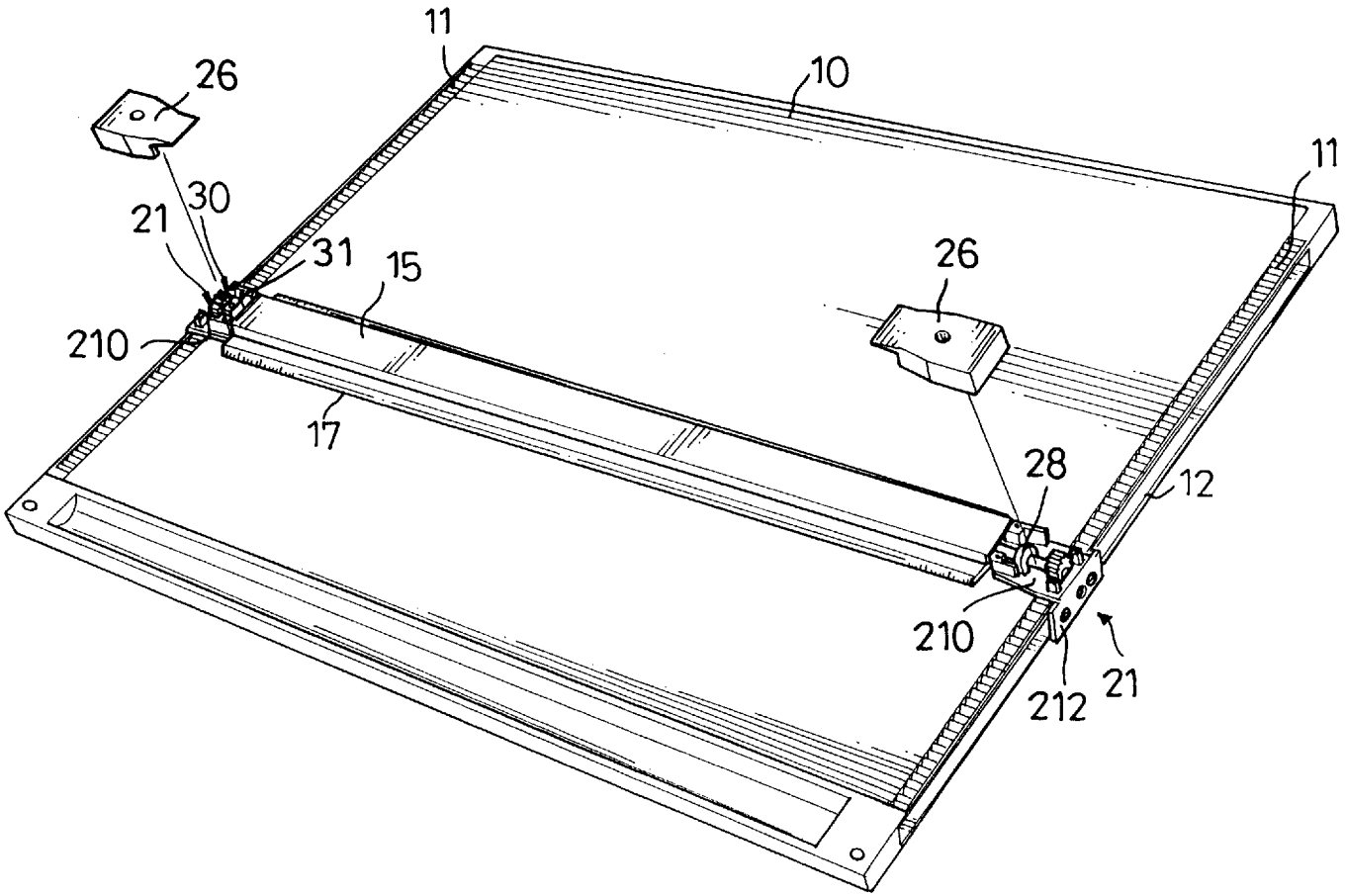
FIG. 1 is a perspective view of a drawing board assembly according to the present invention.
Figure 2:
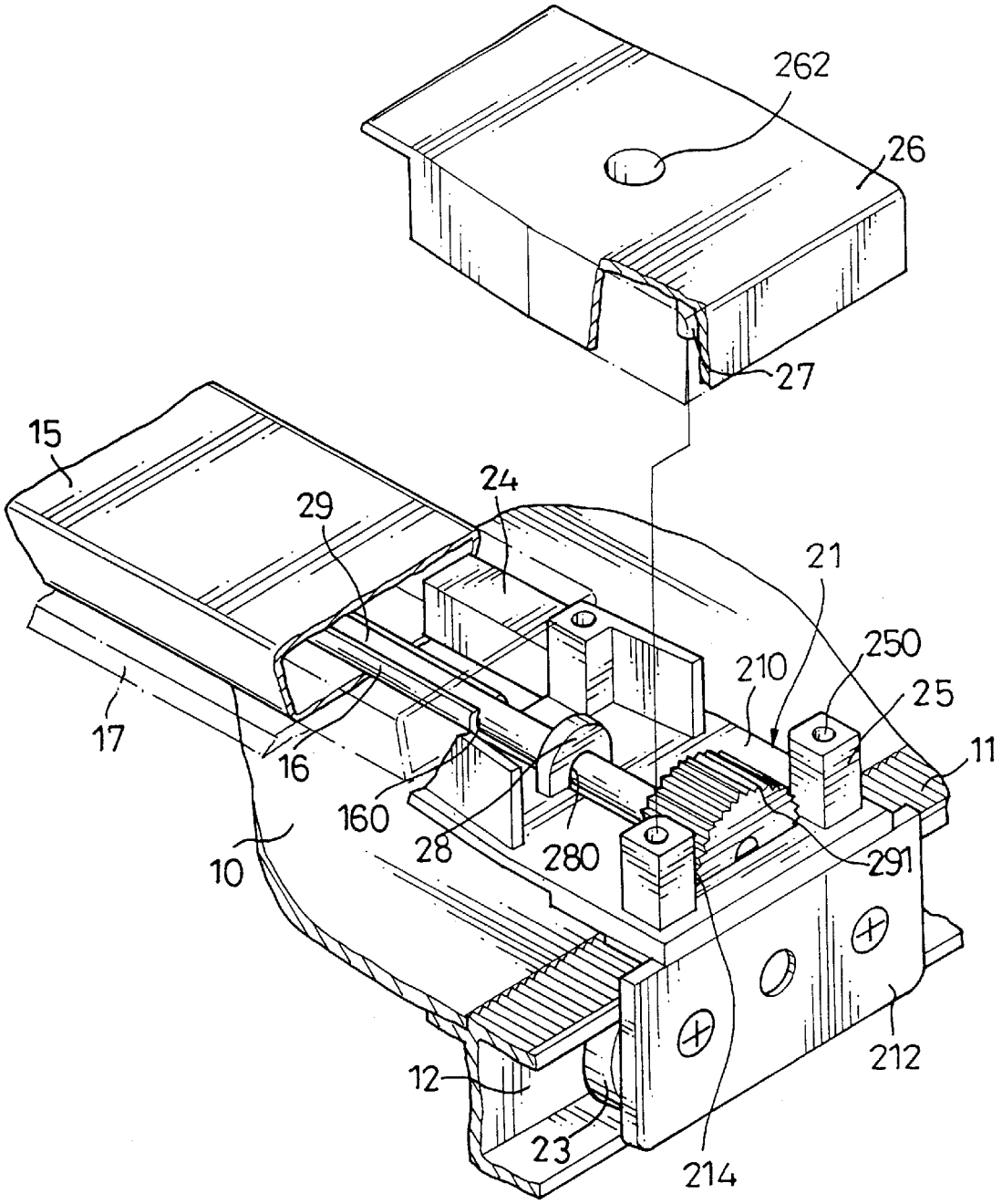
FIGS. 2 and 3 are partially cut-away cross-sectional views of the drawing board assembly as shown in FIG. 1.
Figure 3:
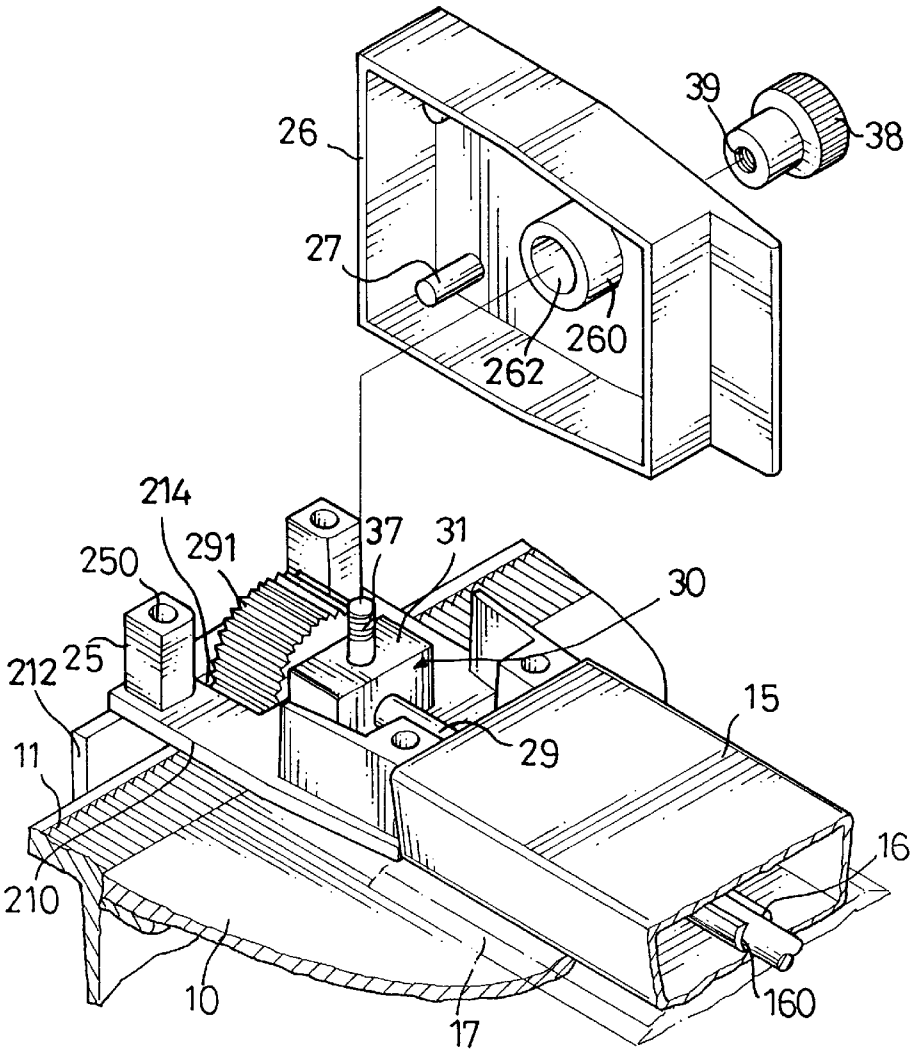

Referring now to FIGS. 1–3, a drawing board assembly according to the present invention comprises a rectangular board 10 including two opposite end portions each having a side wall transversely defining an elongate guiding track 12 therein and a top wall formed with an elongate rack 11.

Two substantially inverted L-shaped sliding bases 21 are each slidably supported on a corresponding one of the two end portions of the board 10 and each include a first plate 210 abutting on the top wall and a second plate 212 abutting on the side wall. Two slides 23 are each fixedly mounted on the second plate 212 of a corresponding one of the two sliding bases 21 and are each slidably received in the guiding track 12.

A ruler 17 is slidably mounted on the board 10, and an elongate frame 15 is fixedly mounted on the ruler 17 and includes two end portions each fixedly connected with the first plate 210 of a corresponding one of the two sliding bases 21.

The first plate 210 of each of the two sliding bases 21 is formed with two inserts 24 each securely fitted into a corresponding one of the two end portions of the frame 15, thereby coupling the frame 15 with each of the two sliding bases 21.

The first plate 210 of each of the two sliding bases 21 defines a slot 214 located above the elongate rack 11. A shaft 29 is rotatably mounted in the elongate frame 15 and includes two end portions each extending outward of the frame. Two gears 291 are each fixedly mounted on a corresponding one of the two end portions of the shaft 29, and each extend through the slot 214 of a corresponding one of the two sliding bases 21. Each gear 291 meshes with the rack 11 of a corresponding one of the two end portions of the board 10.

A limiting bushing 28 is fixedly mounted on the first plate 210 of one of the two sliding bases 21 and defines a hole 280 for receiving one of the two end portions of the shaft 29.

An elongate limiting bar 16 is fixedly mounted in the frame 15 and defines a channel 160 for receiving the shaft 29 therein.

Figure 6:
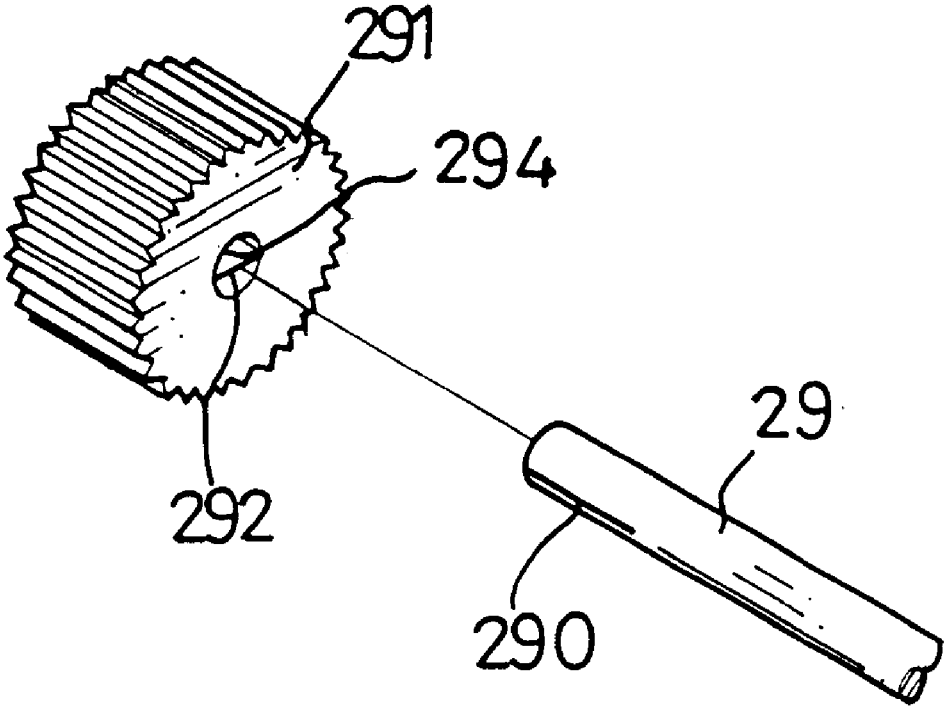
FIG. 6 is an exploded view showing a shaft engaged with a gear.

Especially referring to FIG. 6, each of the two gears 291 defines a hole 294 therein and includes a retaining strip 292 fixedly received in the hole 294. Each of the two end portions of the shaft 29 defines a slit 290 therein for receiving the retaining strip 292 such that each of the gears 291 can be secured on the shaft 29.

Figure 4:
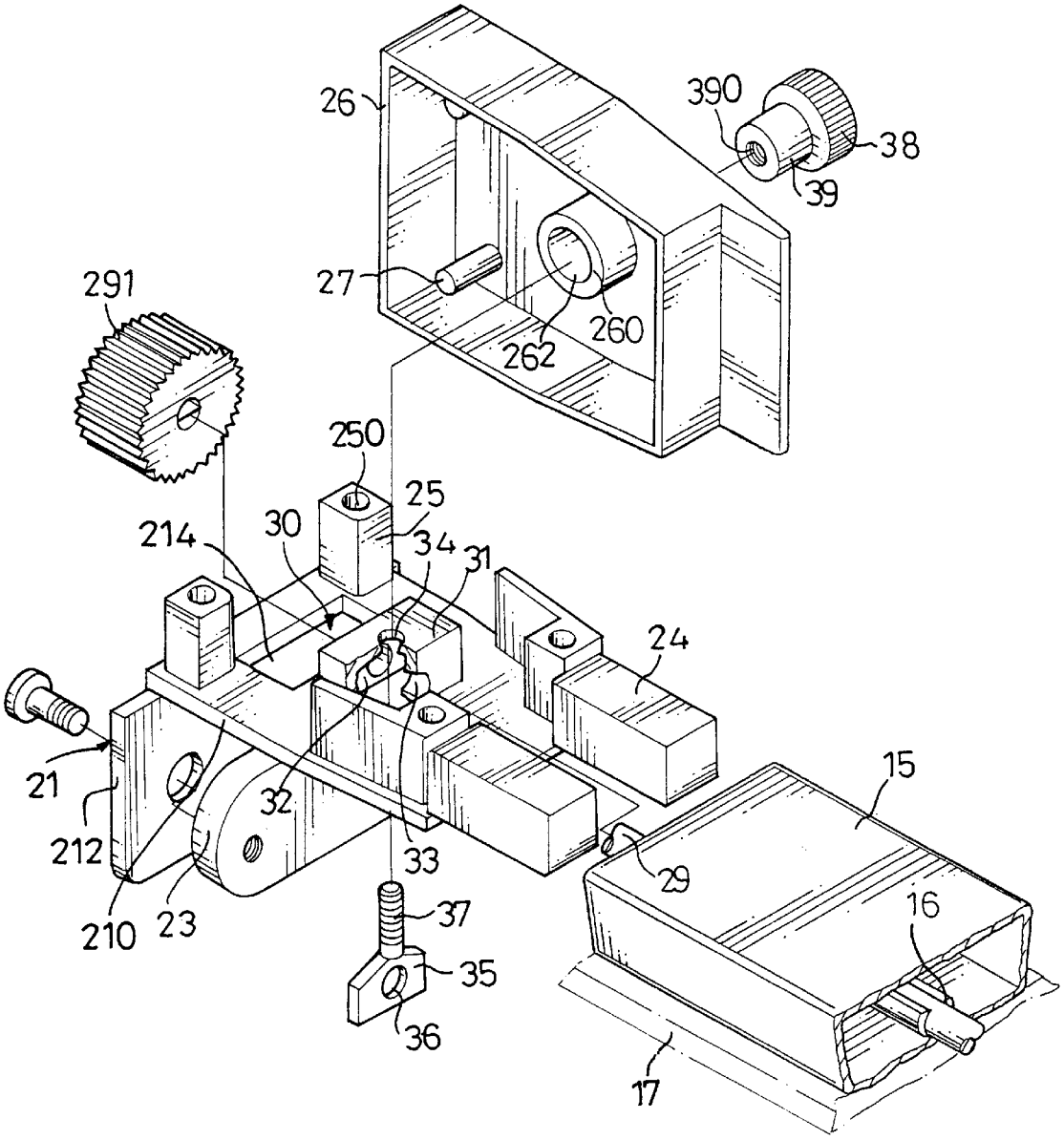
FIG. 4 is a partially cut-away cross-sectional exploded view of the drawing board assembly as shown in FIG. 3.
Figure 5:
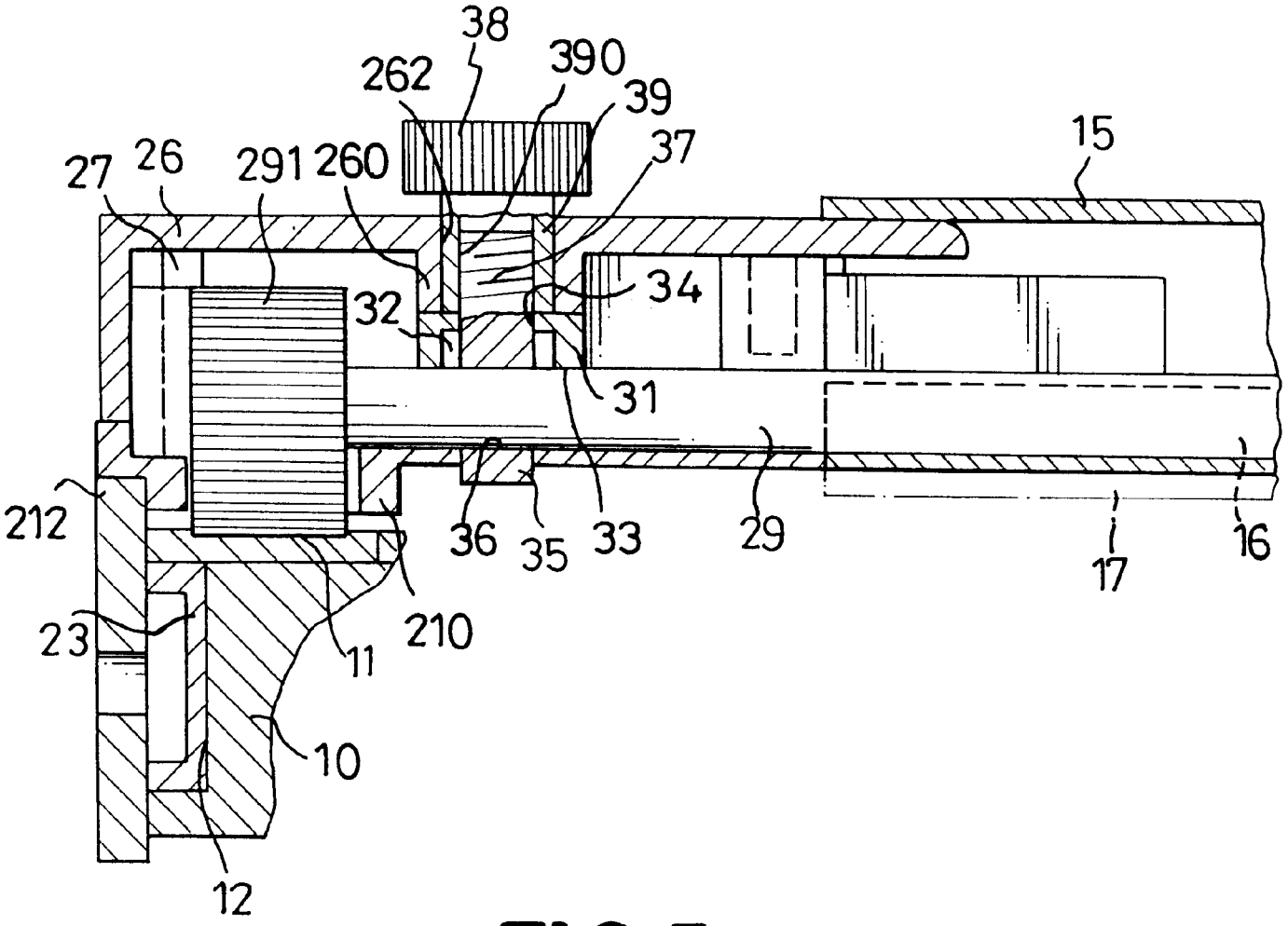
FIG. 5 is a front plan cross-sectional assembly view of it FIG. 4.

Referring to FIGS. 4 and 5 with reference to FIGS. 1–3, a positioning mechanism 30 comprises a body 31 fixedly mounted to the first plate 210 of one of the two sliding bases 21 and including a top wall defining a first hole 34 and two side walls each defining a second hole 33, and a receiving space 32 defined in the body 31 and communicating with the first hole 34 of the top wall and the second hole 33 of each of the two side walls.

A positioning piece 35 is movably received in the receiving space 32 and defines a third hole 36 aligning with the second hole 33 of each of the two side walls of the body 31. A threaded rod 37 extends from the positioning piece 35 and extends through the first hole 34 to be disposed outward of the top wall of the body 31.

One of the two end portions of the shaft 29 extends through the second hole 33 of each of the two side walls of the body 31 and through the third hole 36 of the positioning piece 35 to be engaged on an associated gear 291.

The first plate 210 of each of the two sliding bases 21 is formed with two upright posts 25 each defining a recess 250 therein.

An end cap 26 is fixedly mounted on the first plate 210 of one of the two sliding bases 21 and includes a top wall. Two upright plugs 27 each extend downwardly from an undersurface of the top wall of the end cap 26 and are each received in the recess 250 of a corresponding one of the two posts 25. A sleeve 260 extends from the top wall of the end cap 26 to abut on the top wall of the body 31 and defines a socket 262 communicating with the first hole 34.

A positioning knob 38 includes a shank 39 extending through the socket 262 to rotatably abut on the top wall of the body 31 and defines a threaded bore 390 engagable with the threaded rod 37.

It is to be noted that, another end cap 26 can also be mounted on the other sliding base 21 with each of the two plugs 27 fitted into the recess 250 of the respective post 25. In such a situation, the positioning knob 38 is removed from the end cap 26.

In operation, referring to FIGS. 1–3 with reference to FIGS. 4 and 5, each of the two slides 23 can be guided to slide along the respective guiding track 12, and each of the gears 291 can be rotated on the respective reck 11 such that the frame 15 together with the ruler 17 can be displaced on the board 10 freely.

When a user wishes to position the ruler 17, the positioning knob 38 can be rotated relative to the end cap 26 to move the threaded rod 37 upward which in turn lifts the positioning piece 35 slightly such that the shaft 29 extending through the third hole 36 can be secured by the positioning piece 35, thereby stopping the rotation of the shaft 29 which in turn stops the rotation of each of the two gears 291 on the respective rack 11.

In such a situation, the ruler 17 together with the frame 15 can be disposed in a stationary position by means of each of the two gears 291 meshing with the respective rack 11.

By such an arrangement, the ruler 17 will not swing sidewards during displacing on the board 10 by means of the positioning of the two sliding bases 21 and by means of each of the two gears 291 meshing with the respective rack 11, thereby greatly increasing the precision of the drawing board assembly.

It should be clear to those skilled in the art that further embodiments of the present invention may be made without departing from the spirit and scope of the present invention.

What is claimed is:

1. A drawing board assembly comprising:

a rectangular board (10) including two opposite end portions each having a side wall transversely defining an elongate guiding track (12) therein and a top wall;

two inverted L-shaped sliding bases (21) each slidably supported on a corresponding one of said two end portions of said board (10) and each including a first plate (210) abutting on said top wall and a second plate (212) abutting on said side wall;

two slides (23) each fixedly mounted on said second plate (212) of a corresponding one of said two sliding bases (21) and each slidably received in said guiding track (12);

a ruler (17) slidably mounted on said board (10); and an elongate frame (15) fixedly mounted on said ruler (17) and including two end portions each fixedly connected with said first plate (210) of a corresponding one of said two sliding bases (21).

2. The drawing board assembly according to claim 1, wherein said top wall of each of said two end portions of said board (10) is formed with an elongate rack (11), said first plate (210) of each of said two sliding bases (21) defines a slot (214) located above said elongate rack (11), and said drawing board assembly further comprises a shaft (29) rotatably mounted in said elongate frame (15) and including two end portions, and two gears (291) each fixedly mounted on a corresponding one of said two end portions of said shaft (29), each extending through said slot (214) of a corresponding one of said two sliding bases (21), and each meshing with said rack (11) of a corresponding one of said two end portions of said board (10).

3. The drawing board assembly according to claim 2, further comprising a positioning mechanism (30) comprising:

a body (31) fixedly mounted on said first plate (210) of one of said two sliding bases (21) and including a top wall defining a first hole (34) and two side walls each defining a second hole (33), and a receiving space (32) defined in said body (31) and communicating with said first hole (34) of said top wall and said second hole (33) of each of said two side walls;

a positioning piece (35) movably received in said receiving space (32) and defining a third hole (36) aligning with said second hole (33) of each of said two side walls of said body (31), and a threaded rod (37) extending from said positioning piece (35) and extending through said first hole (34) to be disposed outward of said top wall of said body (31); and a positioning knob (38) including a shank (39) rotatably mounted on said top wall of said body (31) and defining a threaded bore (390) threadedly engaged on said threaded rod (37);

wherein, one of said two end portions of said shaft (29) extends through said second hole (33) of each of said two side walls of said body (31) and through said third hole (36) of said positioning piece (35) to be engaged on an associated said gear (291).

4. The drawing board assembly according to claim 3, wherein said first plate (210) of each of said two sliding bases (21) is formed with two upright posts (25) each defining a recess (250), and said drawing board assembly further comprises an end cap (26) fixedly mounted on said first plate (210) of one of said two sliding bases (21) and including a top wall, two upright plugs (27) each extending from said top wall of said end cap (26) and each received in said recess (250) of a corresponding one of said two posts (25), and a sleeve (260) extending from said top wall of said end cap (26) and abutting on said top wall of said body (31), and a socket (262) defined in said sleeve (260) for receiving said shank (39) of said positioning knob (38).

5. The drawing board assembly according to claim 2, further comprising a limiting bushing (28) fixedly mounted on said first plate (210) of one of said two sliding bases (21) and defining a hole (280) for receiving one of said two end portions of said shaft (29).

6. The drawing board assembly according to claim 2, further comprising a limiting bar (16) fixedly mounted in said frame (15) and defining a channel (160) for receiving said shaft (29) therein.

* * * * *